US009611765B2

(12) United States Patent
Graf

(10) Patent No.: US 9,611,765 B2
(45) Date of Patent: Apr. 4, 2017

(54) METHOD FOR OPERATING A VALVE TRAIN OF AN INTERNAL COMBUSTION ENGINE AND CORRESPONDING VALVE TRAIN

(71) Applicant: AUDI AG, Ingolstadt (DE)

(72) Inventor: Johann Graf, Hausen (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/405,716

(22) PCT Filed: Jun. 5, 2013

(86) PCT No.: PCT/EP2013/001642

§ 371 (c)(1),
(2) Date: Dec. 4, 2014

(87) PCT Pub. No.: WO2013/182300

PCT Pub. Date: Dec. 12, 2013

(65) Prior Publication Data

US 2015/0136052 A1 May 21, 2015

(30) Foreign Application Priority Data

Jun. 5, 2012 (DE) ..... 10 2012 011 116

(51) Int. Cl.
*F01L 1/34* (2006.01)
*F01L 1/344* (2006.01)
*F01L 13/00* (2006.01)

(52) U.S. Cl.
CPC ..... *F01L 1/34413* (2013.01); *F01L 13/0036* (2013.01); *F01L 2013/0052* (2013.01)

(58) Field of Classification Search
CPC ..... F01L 2013/0052; F01L 1/34413
See application file for complete search history.

(56) References Cited

U.S. PATENT DOCUMENTS

2007/0186888 A1 8/2007 Herold
2010/0224154 A1* 9/2010 Elendt ..... F01L 13/0036 123/90.17

(Continued)

FOREIGN PATENT DOCUMENTS

DE 10 2004 012 756 10/2005
DE 10 2004 030 779 1/2006

(Continued)

OTHER PUBLICATIONS

International Search Report issued by the European Patent Office in International Application PCT/EP2013/001642 on Jun. 5, 2013.

*Primary Examiner* — Zelalem Eshete
(74) *Attorney, Agent, or Firm* — Henry M. Feiereisen LLC

(57) ABSTRACT

A method and apparatus for operating a valve train of an internal combustion engine having a main camshaft for which at least one rotationally-fixed cam carrier is provided that can be shifted between two axial positions is disclosed. An actuator cooperates with at least one shift gate to axially shift the cam carrier into a target position. The actuator comprises a driver that is extended in the direction of at least one sliding slot of the shift gate to shift the cam carrier. The sliding slot has an ejection ramp in an ejection region that ejects the driver out of the sliding slot until the conclusion of the shift. A voltage induced in the actuator by the ejection is detected, the induced voltage is integrated across a rotational-angle range associated with the ejection region, and a confirmation signal is generated when the integrated voltage exceeds a threshold level.

12 Claims, 2 Drawing Sheets

(56) References Cited

U.S. PATENT DOCUMENTS

| | | | | |
|---|---|---|---|---|
| 2010/0251982 | A1 | 10/2010 | Elendt | |
| 2011/0079191 | A1 | 4/2011 | Lengfeld | |
| 2011/0088643 | A1* | 4/2011 | Gregor ..... | F01L 13/0036 123/90.11 |
| 2013/0156065 | A1 | 6/2013 | Graf | |

FOREIGN PATENT DOCUMENTS

| | | |
|---|---|---|
| DE | 10 2008 024 086 | 11/2009 |
| DE | 10 2008 029 349 | 12/2009 |
| DE | 10 2009 006 632 | 8/2010 |
| DE | 10 2009 053 116 | 9/2010 |
| DE | 10 2009 016 445 | 10/2010 |
| DE | 10 2010013 216 | 10/2010 |
| DE | 10 2010 012 470 | 9/2011 |
| DE | 10 2010 012 471 | 9/2011 |
| DE | 10 2010 035 186 | 3/2012 |

* cited by examiner

METHOD FOR OPERATING A VALVE TRAIN OF AN INTERNAL COMBUSTION ENGINE AND CORRESPONDING VALVE TRAIN

CROSS-REFERENCES TO RELATED APPLICATIONS

This application is the U.S. National Stage of International Application No. PCT/EP2013/001642, filed Jun. 5, 2013, which designated the United States and has been published as International Publication No. WO 2013/182300 and which claims the priority of German Patent Application, Serial No. 102012011116.9, filed Jun. 5, 2012, pursuant to 35 U.S.C. 119(a)-(d).

BACKGROUND OF THE INVENTION.

The invention is related to a method for operating a valve train of an internal combustion engine, with the valve train having at least one main camshaft on which at least one cam carrier is provided in fixed rotative engagement and axially shiftable between at least two axial positions, and which is associated with an actuator to axially shift the cam carrier into a target position selected from the axial positions, wherein the cam carrier is associated with at least one shift gate that cooperates with the actuator to shift the cam carrier, wherein the actuator has a driver that is pushed out in the direction of at least one sliding slot of the shift gate for shifting the cam carrier, wherein the sliding slot has an ejection ramp in an ejection region for expelling the driver from the sliding slot until completion of the shift, and wherein a voltage induced in the actuator by the expulsion is detected. The invention further relates to a valve train of an internal combustion engine.

The valve trains on which this method is based are generally known. They are used for internal combustion engines in which the working cycle of the gas exchange valves of individual cylinders of the internal combustion engine can be influenced for improving thermodynamic capacity. The at least one cam carrier which can be also called a cam piece is arranged in fixed rotative engagement with and axially shiftable on the main camshaft. Multiple valve-actuating cams, i.e. at least two, are usually assigned to the cam carrier. Each of these valve-actuating cams has an eccentricity provided to operate one of the gas exchange valves of the internal combustion engine at a particular rotational angle position of the main camshaft. The valve-actuating cams thus rotate jointly with the main camshaft so that the respective gas exchange valve of the internal combustion engine is operated by the respectively associated valve-actuating cam or its eccentricity at least once per revolution of the main camshaft. The valve-actuating cam interacts hereby preferably with a roller cam follower of the gas exchange valves by making contact with the latter.

Preferably multiple valve-actuating cams are provided that can be assigned to different cam groups. The valve-actuating cams of a cam group only differ for example from each other with regard to the angular position of their eccentricity or the extension thereof in radial direction (height) and/or in circumferential direction (length). As a result of its axially shifting, the cam carrier can be shifted into at least two axial positions, for example a first and a second axial position. In the first axial position, the gas-exchange valve is operated by a first one of the valve-actuating cams, and in the second by a second one of the valve-actuating cams, which are assigned to the same cam group. In particular the opening time, the opening duration and/or the stroke of the gas exchange valve can thus be selected especially in dependence on an operating mode of the internal combustion engine by shifting the cam carrier. Of course, more than two valve-actuating cams can be provided per cam group, and a corresponding number of axial positions.

The shifting of the cam carrier in axial direction is implemented for example with the aid of a position adjuster that includes a shift gate on the cam carrier and an actuator having a fixed location, usually on a cylinder head of the internal combustion engine. The actuator has for example an extendible driver that can engage in particular a helical or spiral-shaped shift path or shifting slot of the shift gate. The shift path is provided on the shift gate that is assigned to the cam carrier. For example, the shift gate is provided on the cam carrier, or at least interacts with it for axially shifting. The shift path is preferably formed as a radial slot which extends through the circumference of the shift gate, i.e., forming an edged opening in it. The shift gate thus has at least one shift path in which the driver of the actuator can be inserted to shift the cam carrier. The current position of the cam carrier is referred to hereinafter as actual position, and the desired position as target position. The target position is selected from the possible axial positions of the cam carrier. Thereafter, the actuator is operated in such a way that the cam carrier is shifted towards the target position so that subsequent to the shifting, the actual position matches the target position.

The actuator is usually only constructed to push out the driver in the direction of the sliding slot. It does not have any means for moving the driver out of the sliding slot or to move it in again. Therefore, the sliding slot has the ejection ramp that is associated with the ejection region. The ejection ramp extends over the entire ejection region which substantially corresponds to a rotational angle range of the crankshaft of the internal combustion engine. The ejection ramp is arranged so as to ascend radially in the direction of rotation, i.e. the driver received in the sliding slot is brought completely out of the sliding slot by the end of the ejection ramp, or shifted to its initial position. To monitor whether the driver still remains in the sliding slot or has already been brought out of it by the ejection ramp, a voltage induced in the actuator during the expulsion is detected.

Basically, such an approach is known from DE 10 2004 030 779 A1, for example, the content of which is incorporated herewith by reference. Normally, a voltage difference between the induced voltage and an on-board supply voltage has to exceed a particular threshold level over a particular period of time. A confirmation signal or a feedback signal is generated only when this is the case. This indicates the successful expulsion of the driver from the sliding slot by the ejection ramp.

SUMMARY OF THE INVENTION

Object of the invention is to provide a method for operating a valve train that enables a more accurate and reliable detection of the expulsion of the driver from the sliding slot.

In accordance with the invention, this is accomplished by a method for operating a valve train of an internal combustion engine, with the valve train having has at least one main camshaft on which at least one cam carrier is provided in fixed rotative engagement and axially shiftable between at least two axial positions and which is associated with an actuator to axially shift the cam carrier into a target position selected from the axial positions, wherein the cam carrier is associated with at least one shift gate that cooperates with the actuator for shifting the cam carrier, wherein the actuator has a driver that is pushed out in the direction of at least one sliding slot of the shift gate for shifting the cam carrier, wherein the sliding slot has an ejection ramp in an ejection region for expelling the driver from the sliding slot until completion of the shift, and wherein a voltage induced in the actuator by the expulsion is detected, wherein the induced voltage in a particular rotational angle range associated with the ejection region and to generate a confirmation signal, when the integrated voltage exceeds a threshold level. Thus, not only is the course of the induced voltage monitored and the confirmation signal generated when the difference voltage exceeds the threshold level over the particular time period. Rather, the ejection region should be associated with a specific rotational angle range that ideally includes the entire ejection region or at least a particular part of the ejection region. For example, the particular rotational angle range corresponds to 50%, 60%, 70%, 80% or 90% of the trailing ejection region in the direction of rotation. When a rotational angle position of the main camshaft is within this rotational angle range, the induced voltage is then integrated. When the rotational angle position departs the rotational angle range, the voltage integrated in this way is then compared to the threshold level. This is realized in particular upon departure or immediately after departure of the rotational angle position from the rotational angle range. The confirmation signal is generated, when the integrated voltage exceeds the threshold level. Otherwise this does not occur. In this way, generation of the confirmation signal becomes extremely reliable. In particular, in the presence of multiple sliding slots, the confirmation signal can be accurately assigned to the respective ejection region. It can therefore be determined whether the expulsion of the driver from the sliding slot occurs correctly and only after executing the desired shifting of the cam carrier.

According to a refinement of the invention, the threshold level is selected in dependence on the on-board supply voltage. The on-board voltage is the voltage of the on-board power supply of a motor vehicle with which the internal combustion engine is associated. It produces 14 volts for example. Thus, to be able to reliably detect the integrated voltage, the threshold level must be set higher, the higher the on-board supply voltage is.

According to a refinement of the invention, several sliding slots are provided on the shift gate, with the ejection regions of the sliding slots being provided on different, in particular adjacent or spaced-apart, rotational angle ranges. The method can, as already explained above be used especially advantageously for shift gates that have multiple sliding slots. Each of these sliding slots has its own ejection ramp and, consequently, its own ejection region. Advantageously, the ejection regions of the ejection ramps lie in different rotational angle ranges—in relation to the rotational angle position of the main camshaft—that do not overlap each other. For example, these rotational angle ranges are immediately adjacent to one another or are evenly spaced apart from one another, i.e. there is no overlap at all. Correspondingly, the rotational angle ranges in which the integration of the voltage for the various ejection regions is carried out respectively differ from each other. Accordingly, the generated confirmation signal can be reliably assigned to the various sliding slots. Of course, provision may also be made for a partial overlap of the ejection regions and, consequently, the rotational angle ranges.

According to a refinement of the invention, at least two of the sliding slots cross each other. The sliding slots are, for example, configured as XS-slots. This means that both slots initially run parallel in a first region, cross each other in a crossing region, and subsequently again run parallel in a third region. The base of the one slot (S-slot), at least in some areas, in the crossing region in any event, however, is arranged deeper in radial direction than the base of the other slot (X-slot) therein. In other words, the distance of the base from a rotational axis of the shift gate, at least in the crossing region, is less for the. S-slot than for the X-slot. For that reason, the latter has no continuous base. Rather, this is interrupted in the crossing region by the S-slot.

According to a refinement of the invention, the rotational angle range ends after a rotational angle position at which the driver is ejected completely from the sliding slot. The ejection region and thus the particular rotational angle range end at a rotational angle position at which the driver has been forced out of the sliding slot in a radial direction by the ejection ramp.

The invention further relates to a valve train of an internal combustion engine, in particular for carrying out the method as described above, having at least one main camshaft on which at least one cam carrier is provided in fixed rotative engagement and axially shiftable between at least two axial positions, and which is associated with an actuator for axially shifting into a target position selected from the axial positions, wherein the cam carrier is associated with at least one shift gate that cooperates with the actuator to shift the cam carrier, wherein the actuator has a driver that is pushed out in the direction of at least one sliding slot of the shift gate for shifting the cam carrier, wherein the sliding slot has an ejection ramp in an ejection region for expelling the driver from the sliding slot until completion of the shift, and wherein a voltage induced in the actuator by the expulsion is detected. Provision is hereby made to integrate the induced voltage in a particular rotational angle range associated with the ejection region and to generate a confirmation signal, when the integrated voltage exceeds a threshold level. The valve train has appropriate means for carrying out the integration and the generation of the confirmation signal. Its advantages have already been pointed out. The method can be further embodied in accordance with the foregoing embodiments.

BRIEF DESCRIPTION OF THE DRAWING

The invention will be explained hereinafter in greater detail with reference to exemplified embodiments shown in the drawing, without limiting the invention. It is shown in.

DETAILED DESCRIPTION OF PREFERRED EMBODIMENTS

Figure 1:
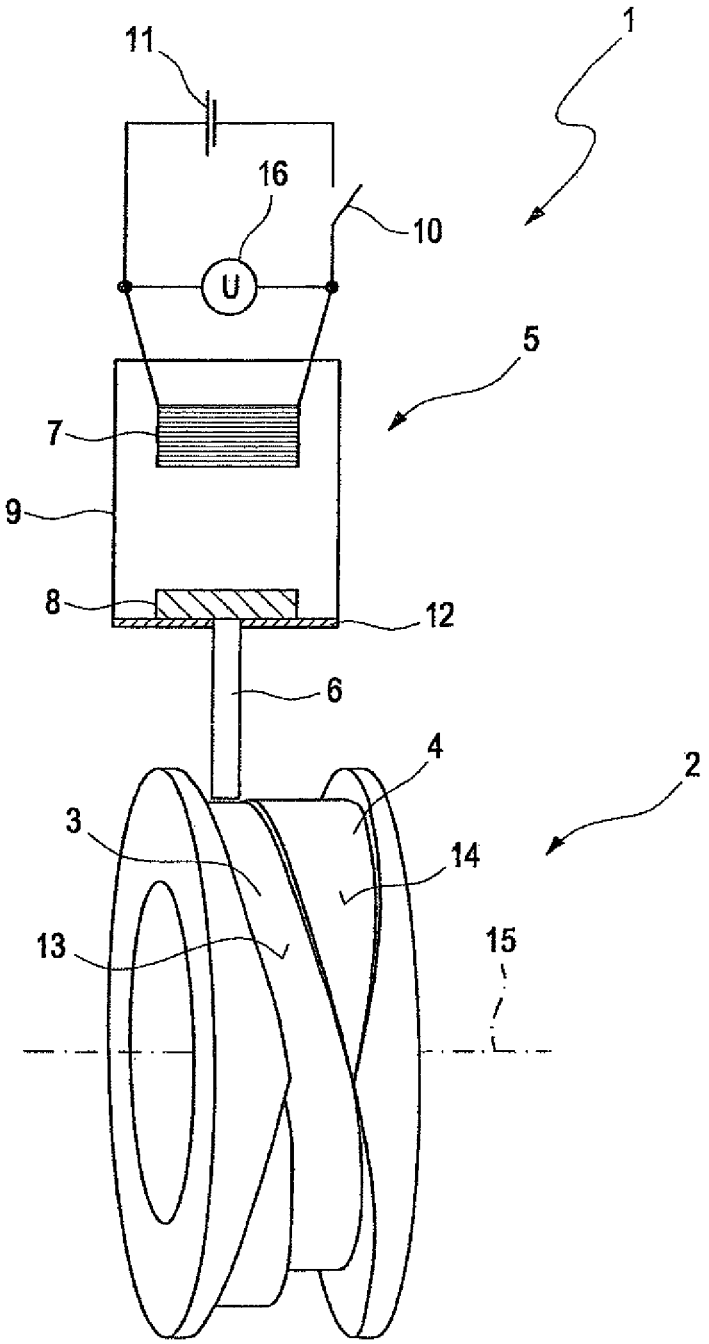
FIG. 1 a schematic illustration of a region of a valve train of an Internal combustion engine, wherein a shift gate and an actuator are illustrated, FIG. 2 the course of two sliding slots of the shift gate, FIG. 3 a diagram depicting voltage waveforms as a function of a rotational angle position of a main camshaft of the valve train during passage through a first one of the sliding slots is shown, and FIG. 4 a diagram known from FIG. 3 for passage through another one of the sliding slots.

FIG. 1 shows an area of a valve train of an internal combustion engine that is not shown in greater detail. The valve train has a main camshaft on which a cam carrier is arranged in fixed rotative engagement and axially shiftable. A shift gate 2 is associated with cam carrier for executing the axial shift and includes in the embodiment shown here two sliding slots 3 and 4. The shifting is performed using an actuator 5 that has a driver 6 which can be inserted into one of the sliding slots 3 and 4. A shifting of the shift gate 2, and consequently of the cam carrier is implemented in one or the other direction in dependence on which of the sliding slots 3 or 4 the driver 6 engages in. Whereas the driver 6 is connected to a permanent magnet 8 that is movable together therewith, the actuator 5 has a coil 7 to move the driver 6 in a radial direction. A housing 9 of the actuator 5 is preferably made of metal. The coil 7 is electrically connectable to a power source 11 via a switching element 10. In the presence of this connection, the coil 7 generates a magnetic field which urges the permanent magnet 8 in the direction of the shift gate 2, preferably until the permanent magnet 8 reaches an end stop 12. The end stop 12 is preferably made of metal so that the driver 6, as a result of the magnetic field generated by the permanent magnet 8, settles into the position indicated in FIG. 1 and rests upon the end stop 12.

Each of the sliding slots 3 and 4 has an ejection ramp (not shown) which pushes or expels the driver 6 out of the sliding slot 3 after executing the shift In the ejection region associated with the ejection ramp, a distance of a base 13 or 14 of the sliding slot 3 or 4, respectively, from a rotational axis 15 of the shift gate 2 or a main camshaft on which the cam carrier is arranged, preferably becomes steadily greater. The ejection ramps are hereby configured in such a manner that the driver 6 is fully dislodged from the sliding slots 3 and 4 after the shifting of the cam carrier. The permanent magnet 8 comes hereby preferably into contact with the coil 7 to which current is no longer applied. Accordingly, the magnetic force of the permanent magnet 8 causes the driver 6 to be held in the dislodged position, i.e. its initial position, until current is applied again to the coil 7 using the switching element 10. During expulsion of the driver 6 from the sliding slots 3 and 4, a voltage is induced in the coil 7 that can be detected by a suitable sensor 16.

Figure 2:
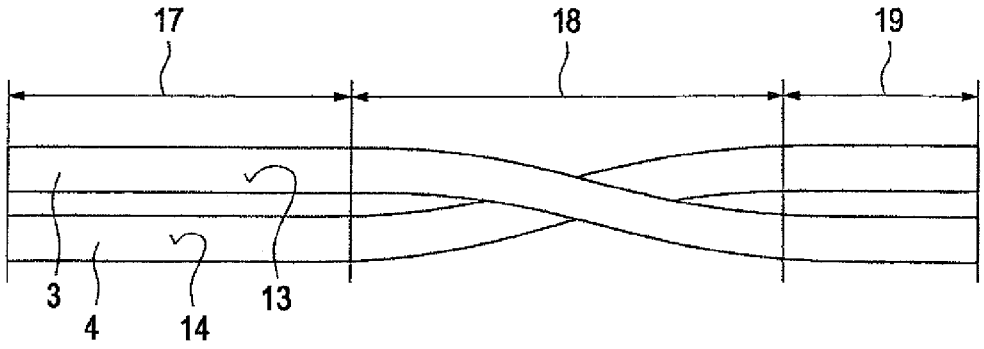

FIG. 2 shows the course of the sliding slots 3 and 4 which are each subdivided into a first region 17, a crossing region 18 and a third region 9. It is readily apparent that the two sliding slots 3 and 4 intersect each other in the crossing region 18, wherein the base 13 of the sliding slot 3 is configured continuously while the base 14 of the sliding slot 4 is interrupted by the sliding slot 3. The ejection ramps of the sliding slots 3 and 4 respectively are arranged, for example, in the third region 19, preferably however in ejection regions that are different from one another.

Figure 3:
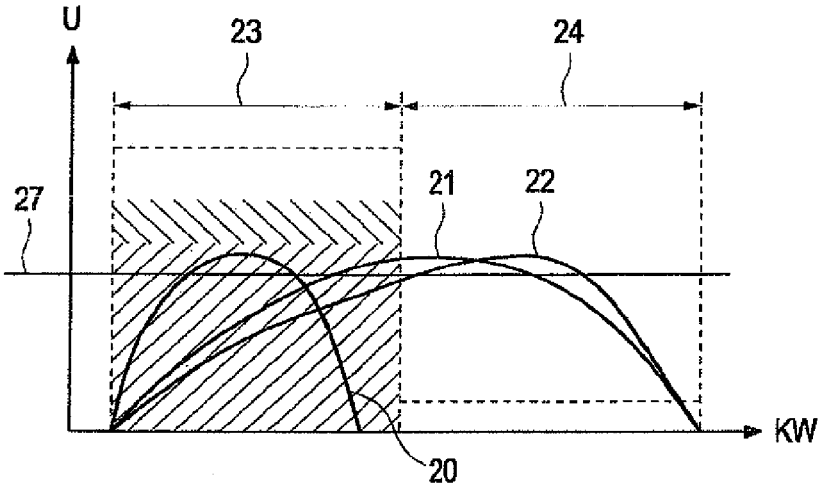

FIG. 3 shows a diagram in which the voltage, induced by the coil 7 as the driver 6 is expelled, is plotted as a function of the crankshaft angle or the rotational angle position of the main camshaft. Three waveforms 20, 21, and 22 are shown. Rotational angle ranges 23 and 24 are also indicated, wherein the former is associated with the ejection region of ejection ramp of the sliding slot 3, and the latter with the ejection region of the ejection ramp of the sliding slot 4. The rotational angle ranges 23 and 24 are normally provided in the third region 19 shown in FIG. 2. They preferably are directly adjacent to one another, which means that the ejection ramps are arranged in offset relationship. As the driver 6 passes through the sliding slots 3 and 4, it is advantageous when being able to determine which of the ejection ramps the driver 6 is expelled from. The waveforms 20 to 22 represent exemplary waveforms of the induced voltage. It can be seen that the waveform 20 can be unambiguously associated with the rotational angle range 23, while that is doubtful for the waveform 22 and impossible for the waveform 21. Thus, detection and integration of the voltage induced in the rotational angle ranges 23 and 24 is provided. A confirmation signal is generated, when the voltage integrated in this way exceeds a threshold level, and indicates the successful expulsion of the driver 6 from the respective sliding slot, slot 3 or 4.

Figure 4:
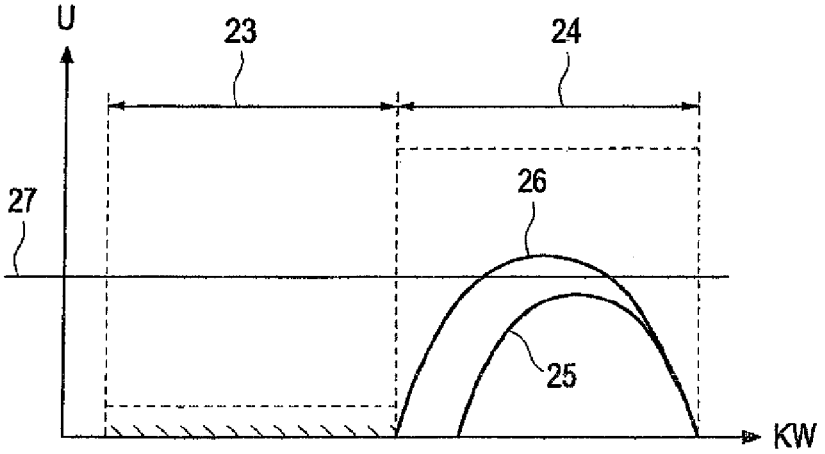

FIG. 4 shows a diagram analogous to FIG. 3. However, waveforms 25 and 26 are shown here as the driver 6 passes through the sliding slot 4. It is also clear here that the waveform 25 can unambiguously be assigned to the rotational angle range 24. This, however, is again not unambiguously possible for waveform 26. Both diagrams of FIGS. 3 and 4 respectively depict in addition the integrated induced voltages having magnitudes which are indicated by broken lines for each rotational angle range 23 and 24 by way of example. In the diagram of FIG. 3, a threshold level 27 is exceeded in the rotational angle range 23. Accordingly, the confirmation signal can be generated for the sliding slot 3. In the diagram of FIG. 4, the threshold level is not reached in the rotational angle range 23, but reached in the rotational angle range 24. Accordingly, the confirmation signal is generated for the sliding slot 4. By the evaluation of the integrated induced voltage, an unequivocal association to the sliding slots 3 and 4 is possible, as opposed to the evaluation based on the waveforms 20 to 22 or 25 and 26. Thus, the reliability of the recognition of the successful expulsion of the driver 6 from the sliding slots 3 and 4 is significantly improved.

The invention claimed is:

1. A method for operating a valve train of an internal combustion engine with a main camshaft and a rotationally-fixed and axially shiftable cam carrier that is associated with a shift gate having at least two sliding slots and an actuator-configured to axially shift the cam carrier between at least two axial positions, wherein each of the sliding slots has a respective ejection ramp in a respective ejection region adapted for radially ejecting the driver out of the actuator out of the respective sliding slot, wherein the respective ejection regions of different sliding slots are located in different rotational angle ranges of the cam carrier, the method comprising:

inducing a voltage in the actuator during ejection of the driver from a respective sliding slot;

integrating the voltage induced in the actuator over the rotational-angle range associated with each ejection region of a respective sliding slot;

associating with each of the different rotational angle ranges a respective threshold value for an expected integrated voltage of the respective rotational angle range;

checking for each of the different rotational angle ranges whether the integrated voltage in one of the rotational angle ranges exceeds the respective threshold value; and when the integrated voltage in one of the rotational angle ranges exceeds the given threshold value, generating based on the exceeded threshold value a confirmation signal indicating which of the sliding slots the driver has been ejected from.

2. The method of claim 1, wherein the internal combustion engine has an on-board supply voltage, further comprising the step of selecting a voltage value for the threshold level depending upon a voltage of the on-board supply voltage.

3. The method of claim 1, wherein the ejection regions of different sliding slots lie in adjacent rotational angle ranges.

4. The method of claim 1, wherein the ejection regions of different sliding slots lie in spaced-apart rotational angle ranges.

5. The method of claim 1, wherein different sliding slots on the shift gate cross each other.

6. The method of claim 1, wherein the rotational angle range ends at a rotational-angle position at which the driver is entirely pushed out of a respective sliding slot.

7. A valve train of an internal combustion engine with a main camshaft with a rotationally-fixed and axially shiftable cam carrier between at least two axial positions, the valve train comprising:

an actuator having a driver configured to axially shift the cam carrier into a target position selected from the at least two axial positions;

a shift gate associated with the cam carrier that co-operates with said actuator for shifting the cam carrier, said shift gate having at least two sliding slots that cooperate with the actuator for axially shifting the cam carrier, wherein each sliding slot comprises a respective election ramp located in a respective election region, wherein the respective ejection regions of different sliding slots are located in different rotational angle ranges of the cam carrier, wherein each ejection ramp is adapted to eject the driver out of the respective sliding slot in the respective rotational angle range where the respective sliding slot is located;

a magnetic device adapted to induce a voltage in the actuator during the ejection of the driver from a respective sliding slot;

an integration device adapted to integrate the voltage induced in said actuator over the respective rotational-angle ranges associated with the of the at least two different sliding slots and to determine whether the integrated voltage in one of the rotational angle ranges exceeds a respective threshold value associated with the respective ejection region; and a signal generator adapted to generate, when the integrated voltage exceeds the given threshold value, based on the exceeded threshold value a confirmation signal indicating which of the sliding slots the driver has been elected from.

8. The valve train of claim 7, wherein the internal combustion engine has an on-board supply voltage and the voltage value of the threshold level depends upon a voltage value of the on-board supply voltage.

9. The valve train of claim 7, wherein the ejection regions of different sliding slots lie in adjacent rotational angle ranges.

10. The valve train of claim 7, wherein the ejection regions of different sliding slots lie in spaced-apart rotational angle ranges.

11. The valve train of claim 7, wherein the at least two sliding slots of the shift gate cross each other.

12. The valve train of claim 7, wherein the rotational angle range ends at a rotational angle position at which the driver is entirely pushed out of a respective sliding slot.

* * * * *